US010174898B2

(12) United States Patent
Ichikawa

(10) Patent No.: US 10,174,898 B2
(45) Date of Patent: Jan. 8, 2019

(54) LIGHT SOURCE MODULE

(71) Applicant: KOITO MANUFACTURING CO., LTD., Tokyo (JP)

(72) Inventor: Tomoyuki Ichikawa, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/951,868

(22) Filed: Apr. 12, 2018

(65) Prior Publication Data

US 2018/0238508 A1 Aug. 23, 2018

Related U.S. Application Data

(62) Division of application No. 15/063,630, filed on Mar. 8, 2016, now Pat. No. 9,989,209.

(30) Foreign Application Priority Data

Mar. 11, 2015 (JP) ..... 2015-048587

(51) Int. Cl.

| | |
|---|---|
| ***F21V 29/00*** | (2015.01) |
| ***F21S 41/14*** | (2018.01) |
| ***F21S 41/19*** | (2018.01) |
| ***F21S 43/19*** | (2018.01) |
| ***F21S 43/13*** | (2018.01) |
| ***F21S 45/47*** | (2018.01) |
| ***F21S 41/16*** | (2018.01) |

(52) U.S. Cl.

CPC ..... *F21S 41/14* (2018.01); *F21S 41/16* (2018.01); *F21S 41/192* (2018.01); *F21S 43/13* (2018.01); *F21S 43/195* (2018.01); *F21S 45/47* (2018.01)

(58) Field of Classification Search

CPC . F21K 9/20; F21S 41/14; F21S 41/141; F21S 41/16; F21S 41/19; F21S 41/192; F21S 43/13; F21S 43/14; F21S 43/19; F21S 43/195; F21S 45/47; F21V 19/003; F21V 19/006; F21V 19/0065

USPC ..... 362/249.02, 294, 800

See application file for complete search history.

(56) References Cited

U.S. PATENT DOCUMENTS 8,444,308 B2 * 5/2013 Matsunaga ..... F21K 9/00 362/548

FOREIGN PATENT DOCUMENTS

JP 2006-278361 A 10/2006

* cited by examiner

*Primary Examiner* — Jason M Han

(74) *Attorney, Agent, or Firm* — Osha Liang LLP

(57) ABSTRACT

A light source module includes light source having a light emitting element, a stem configured to support the light emitting element, and a terminal, one end side of which is electrically connected to the light emitting element, a wiring portion to which the other end of the terminal is electrically connected and which is configured to electrically connect the terminal to an external power supply terminal, a connection portion configured to fix the wiring portion and the other end side of the terminal by a connection member, and a thermal diffusion member disposed between the stem and the connection portion and thermally connected to the light emitting element, the terminal has a bent portion which is deformed in accordance with dimensional change in at least one of the thermal diffusion member, the terminal, the wiring portion and the connection member.

4 Claims, 5 Drawing Sheets

LIGHT SOURCE MODULE

CROSS-REFERENCE TO RELATED APPLICATIONS

The present application is a divisional of U.S. patent application Ser. No. 15/063,630 filed on Mar. 8, 2016, and claims priority from Japanese Patent Application No. 2015-048587 filed on Mar. 11, 2015, the entire content of which is incorporated herein by reference.

BACKGROUND

Technical Field

The present invention relates to a light source module and, more particularly, to a light source module used in a lamp of a vehicle such as an automobile.

A related-art light source module has a structure where a laser light source including a laser element and a metal stem on which the laser element is mounted and is mounted on a circuit board (e.g., see Patent Document 1). In the light source module, the laser light source is connected to the circuit board in a state of being press-fitted into a hole of a metal heat-dissipation plate. A side surface of the stem is in contact with a side surface of the hole of the heat-dissipation plate, so that heat of the laser light source is transferred to the heat-dissipation plate from the side surface of the stem.

Patent Document 1: Japanese Patent Laid-Open Publication No. 2006-278361

The present inventor has studied about the light source module having the structure described above in order to further enhance heat dissipation of the light source. Further, the present inventor has found that connection reliability between the light source and a wiring portion such as a circuit board may be decreased when the structure of the light source module is devised in order to enhance heat dissipation of the light source.

SUMMARY

Exemplary embodiments of the invention provide a light source module which can achieve both improvement in heat dissipation of a light source and prevention of decrease in connection reliability between a light source and a wiring portion.

One aspect of the present invention is a light source module. The light source module comprises:

- a light source having a light emitting element, a stem configured to support the light emitting element, and a terminal, one end side of which is electrically connected to the light emitting element;
- a wiring portion to which the other end of the terminal is electrically connected and which is configured to electrically connect the terminal to an external power supply terminal;
- a connection portion configured to fix the wiring portion and the other end side of the terminal by a connection member; and
- a thermal diffusion member disposed between the stem and the connection portion and thermally connected to the light emitting element,
- wherein the terminal has a bent portion which is deformed in accordance with dimensional change in at least one of the thermal diffusion member, the terminal, the wiring portion and the connection member.

According to this aspect, it is possible to achieve both improvement in heat dissipation of the light source and prevention of decrease in connection reliability between the light source and the wiring portion.

Another aspect of the present invention is also a light source module. The light source module comprises:

- a light source having a light emitting element, a stem configured to support the light emitting element, and a terminal, one end side of which is electrically connected to the light emitting element;
- a wiring board to which the other end of the terminal is electrically connected and which is configured to electrically connect the terminal to an external power supply terminal;
- a connection portion configured to fix the wiring board and the other end side of the terminal by a connection member;
- a thermal diffusion member disposed between the stem and the connection portion and thermally connected to the light emitting element; and
- an elastic material which is interposed between the wiring board and the thermal diffusion member and is deformed in accordance with dimensional change in at least one of the thermal diffusion member, the terminal, the wiring board and the connection member.

Also according to this aspect, it is possible to achieve both improvement in heat dissipation of the light source and prevention of decrease in connection reliability between the light source and the wiring portion.

Yet another aspect of the present invention is also a light source module. The light source module comprises:

- a light source having a light emitting element, a stem configured to support the light emitting element, and a terminal, one end side of which is electrically connected to the light emitting element;
- a bus bar to which the other end side of the terminal being electrically connected and which is configured to electrically connect the terminal to an external power supply terminal; and
- a thermal diffusion member disposed between the stem and a connection portion of the bus bar and the terminal and thermally connected to the light emitting element,
- wherein the bus bar is deformed in accordance with dimensional change in at least one of the thermal diffusion member, the terminal and the bus bar.

Also according to this aspect, it is possible to achieve both improvement in heat dissipation of the light source and prevention of decrease in connection reliability between the light source and the wiring portion.

According to the present invention, it is possible to provide a technology for achieving both improvement in heat dissipation of the light source and prevention of decrease in connection reliability between the light source and the wiring portion.

BRIEF DESCRIPTION OF THE DRAWINGS

4B and 4C are views schematically showing the shape of bent portions according to a second modified example.

DETAILED DESCRIPTION

Figure 1:
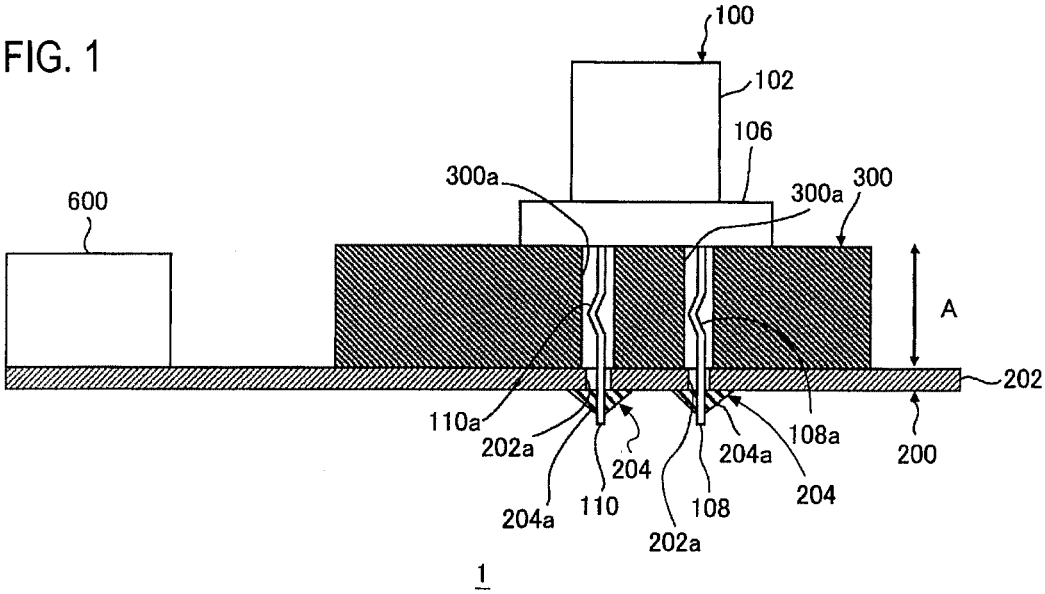
FIG. 1 is a sectional view showing a schematic structure of a light source module according to a first embodiment.

Hereinafter, exemplary embodiments of the present invention will be described with reference to the drawings. The same or similar elements, members and process shown in each of the drawings are denoted by the same or similar reference numerals and a duplicated description thereof will be omitted, as appropriate. Further, the embodiment is illustrative and not intended to limit the present invention. It should be noted that all the features and their combinations described in the embodiment are not necessarily considered as an essential part of the present invention.

First, before specifically describing the embodiments, the knowledge found by the present inventor will be described. The present inventor has studied about a light source module including a light source having a laser element or other light emitting elements and a wiring portion to which the light source is electrically connected, in order to enhance heat dissipation of the light source. Further, the present inventor, as a method of enhancing the heat dissipation of the light source, has conceived that a thermal diffusion member having a high thermal conductivity is disposed between the light source and the wiring portion. In this way, it is possible to increase the contact area between a stem and a thermal diffusion member, as compared to a case where the thermal diffusion member is in contact with the side surface of the stem of the light source as in the related art. As a result, it is possible to enhance the heat dissipation of the light source.

However, the thermal diffusion member, the terminal and the wiring portion may be dimensionally changed due to thermal expansion or the like. Further, when the terminal and the wiring portion are connected to each other by a connection member such as a solder, the dimension of the connection member may be changed due to thermal expansion or the like. In the structure where the thermal diffusion member is disposed between the light source and the wiring portion, force in directions away from each other is applied to a connection portion for connecting the terminal of the light source and the wiring portion, and the light emitting element when the thermal diffusion member is thermally expanded, for example. Further, the force in directions away from each other may be applied to the connection portion and the light emitting element also due to the dimensional change in the terminal, the wiring portion and the connection member. Thus, stress is applied to the connection portion, and hence, crack or the like occurs in the connection portion. Accordingly, there is a possibility that connection failure occurs between the light source and the wiring portion. The present inventor has reached the light source module to be described below, based on the knowledge described above.

First Embodiment

Figure 2:
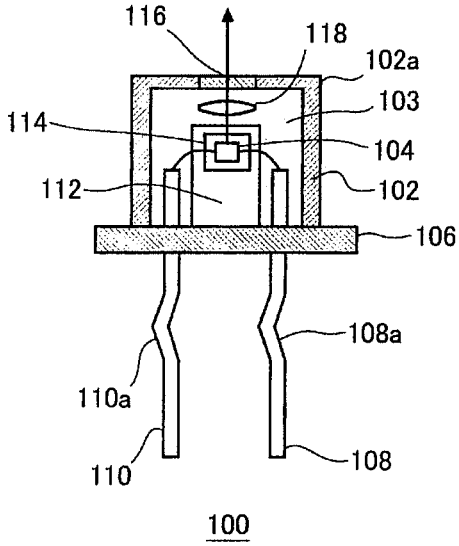
FIG. 2 is a sectional view showing a schematic structure of a light source.

FIG. 1 is a sectional view showing a schematic structure of a light source module according to a first embodiment. In FIG. 1, internal structures of a light source 100 and an external power supply terminal 600 are not shown. FIG. 2 is a sectional view showing a schematic structure of a light source. A light source module 1 according to the present embodiment is used in a vehicle lamp, for example. As shown in FIG. 1, the light source module 1 includes the light source 100, a wiring portion 200, a connection portion 204, and a thermal diffusion member 300.

As shown in FIGS. 1 and 2, the light source 100 includes, as a main configuration, a cap 102, a light emitting element 104, a stem 106, and at least two terminals 108, 110. The light source 100 is the same as a related-art CAN package except for the structure of the terminals 108, 110. That is, the light source 100 has a structure where the terminals 108, 110 extend to the outside through the stem 106 from a space to accommodate the light emitting element 104. Therefore, the terminals 108, 110 protrude from a main surface of the stem 106.

Specifically, the light source 100 has an internal space 103 formed by the cap 102 and the stem 106. The light emitting element 104 is accommodated in the internal space 103. The internal space 103 is hermetically sealed. The light emitting element 104 is a related-art laser element. The stem 106 is a plate-like metal member and supports the light emitting element 104. Specifically, a heat-dissipation block 112 is fixed to the surface of the stem 106, which is in contact with the internal space 103. Further, a sub-mount 114 is fixed to the heat-dissipation block 112, and the light emitting element 104 is mounted on the sub-mount 114. Therefore, the stem 106 supports the light emitting element 104 through the heat-dissipation block 112 and the sub-mount 114.

One electrode of the light emitting element 104 is electrically connected to one end side of one terminal 108. The other electrode of the light emitting element 104 is electrically connected to one end side of the other terminal 110. The terminals 108, 110 are fixed to the stem 106 in a state of being electrically insulated from the stem 106. The terminals 108, 110 have bent portions 108*a*, 110*a*. The bent portions 108*a*, 110*a* are provided on the other end side (on the side opposite to the side connected to the electrode of the light emitting element 104) of the terminals 108, 110 than the stem 106.

The bent portions 108*a*, 110*a* have a structure that is bent so as to protrude in a direction intersecting with an arrangement direction of the light source 100 and the wiring portion 200. That is, the bent portions 108*a*, 110*a* have a spring structure and are responsible for absorbing the stress applied to the connection portion 204 to be described below. An operation of the bent portions 108*a*, 110*a* will be described in detail later. A window 102*a* for extracting the light of the light emitting element 104 to the outside is provided on an upper surface of the cap 102. The window 102*a* is provided with a wavelength conversion portion 116 for converting the wavelength of at least a portion of the light of the light emitting element 104. As the wavelength conversion portion 116, those obtained by dispersing powder phosphor in transparent resin or glass, or a ceramic obtained by sintering the powder phosphor, or the like is exemplified. A lens 118 is provided on an optical path of emission light from the light emitting element 104 between the light emitting element 104 and the wavelength conversion portion 116. The lens 118 is, for example, a collimator lens for converting the light emitted from the light emitting element 104 into parallel light.

As shown in FIG. 1, the wiring portion 200 is a member for electrically connecting the terminals 108, 110 of the light source 100 to the external power supply terminal 600. In the present embodiment, the wiring portion 200 is a related-art printed wiring board. The wiring portion 200 includes a resin board 202 such as a glass epoxy board and a conductive wiring pattern (not shown) formed on the surface of the board 202. The board 202 has a plurality of through holes 202*a* at a region on which the light source 100 is mounted. The other end side of the terminals 108, 110 is inserted through the through holes 202*a*. The wiring pattern is configured such that one end side is arranged at a peripheral edge portion of the through holes 202*a*. The other end side of the terminals 108, 110 and the one end side of the wiring pattern are electrically connected to each other by being fixed to each other by a connection member 204*a* such as a solder. In this way, the connection portion 204 between the wiring portion 200 and the terminals 108, 110 is formed.

The external power supply terminal 600 is provided at a predetermined region, for example, at a peripheral edge portion of the board 202. In the present embodiment, the external power supply terminal 600 has a connector shape. An external power supply is connected to the external power supply terminal 600. Further, the other end side of the wiring pattern is electrically connected to the external power supply terminal 600. Therefore, when the external power supply is connected to the external power supply terminal 600, power is supplied to the light emitting element 104 via the external power supply terminal 600, the wiring pattern, the connection portion 204 and the terminals 108, 110. Further, a control circuit (not shown) for controlling the output of the light emitting element 104, or a thermistor (not shown) for detecting the temperature of the light source 100, or the like is provided on the board 202.

The thermal diffusion member 300 is made of a material having a high thermal conductivity, such as a metal. As the metal used as the thermal diffusion member 300, aluminum or the like can be exemplified. The thermal diffusion member 300 is disposed between the stem 106 of the light source 100 and the connection portion 204 and is thermally connected to the light emitting element 104. The thermal diffusion member 300 is fixed to the wiring portion 200 by a fastener (not shown) such as a screw, for example. The thermal diffusion member 300 has a plurality of through holes 300*a* at positions corresponding to the through holes 202*a* of the board 202. The terminals 108, 110 are inserted through the through holes 300*a* and the through holes 202*a*, and leading ends thereof are electrically connected to the wiring pattern at the connection portion 204.

The heat generated in the light emitting element 104 can be diffused by the thermal diffusion member 300. The heat generated in the light emitting element 104 is transferred to the thermal diffusion member 300 via the sub-mount 114, the heat-dissipation block 112 and the stem 106. The thermal diffusion member 300 is in contact with the main surface of the stem 106. Therefore, it is possible to enhance the heat dissipation of the light source 100, as compared to a case where the thermal diffusion member 300 is in contact with only the side surface of the stem 106. The thermal diffusion member 300 is connected to a heat sink (not shown), and the heat transferred to the thermal diffusion member 300 is dissipated mainly through the heat sink.

Figure 3:
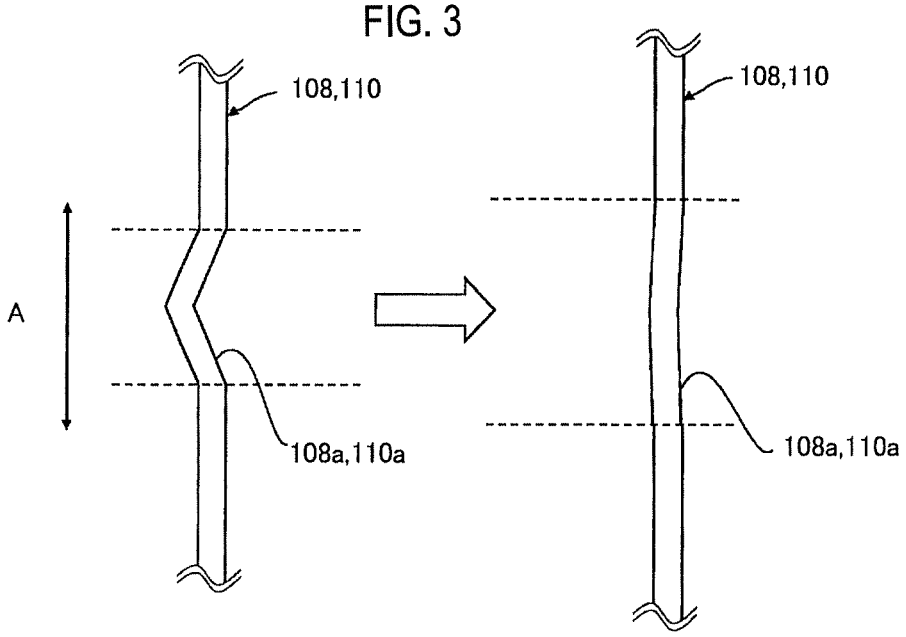
FIG. 3 is a schematic view for explaining deformation of bent portions in accordance with the dimensional change in at least one of a thermal diffusion member, a terminal, a wiring portion and a connection member.

Next, an operation of the bent portions 108*a*, 110*a* will be described when the dimension of at least one of the thermal diffusion member 300, the terminals 108, 110, the wiring portion 200 and the connection member 204*a* is changed. FIG. 3 is a schematic view for explaining deformation of the bent portions in accordance with the dimensional change in at least one of the thermal diffusion member, the terminals, the wiring portion and the connection member. A left view in FIG. 3 shows a state of the bent portions before deformation and a right view in FIG. 3 shows a state of the bent portions after deformation.

The thermal diffusion member 300 is configured such that the temperature is raised by the heat transferred from the light source 100 and is dropped by the heat dissipation through the heat sink. At that time, the thermal diffusion member 300 is expanded or contracted, and hence, the dimension thereof is changed. Further, as described above, the light source module 1 has a structure where the thermal diffusion member 300 is sandwiched between the board 202 and the stem 106. Therefore, for example, when the thermal diffusion member 300 is thermally expanded, and hence, the dimension thereof is increased, a force A (force in a direction indicated by an arrow A in FIGS. 1 and 3A) of widening a gap between the light source 100 and the connection portion 204 occurs in the light source module 1. Similarly, the terminals 108, 110, the wiring portion 200 and the connection member 204*a* are expanded or contracted in accordance with the temperature change due to the absorption and dissipation of heat transferred from the light source 100, and hence, the dimensions thereof are changed. The force A may also occur in accordance with this dimensional change. When the force A occurs, stress is applied to the connection portion 204. As a result, crack or the like occurs in the connection member 204*a* of the connection portion 204, and hence, there is a possibility that connection reliability between the light source 100 and the wiring portion 200 is decreased.

On the other hand, the light source module 1 has the bent portions 108*a*, 110*a* as a stress alleviation mechanism for alleviating the stress applied to the connection portion 204 due to the dimensional change in at least one of the thermal diffusion member 300, the terminals 108, 110, the wiring portion 200 and the connection member 204*a*. The bent portions 108*a*, 110*a* are deformed in accordance with the dimensional change in at least one of the thermal diffusion member 300, the terminals 108, 110, the wiring portion 200 and the connection member 204*a*. Specifically, when the force A occurs due to the dimensional change in at least one of the thermal diffusion member 300, the terminals 108, 110, the wiring portion 200 and the connection member 204*a*, the terminals 108, 110 are tensioned in an extension direction thereof, and hence, the bent portions 108*a*, 110*a* are deformed in a shape closer to a straight line. In this way, a distance between both ends of the terminals 108, 110 is increased and a distance between the light source 100 and the connection portion 204 is allowed to be changed in accordance with the dimensional change in at least one of the thermal diffusion member 300, the terminals 108, 110, the wiring portion 200 and the connection member 204*a*. As a result, the stress applied to the connection portion 204 is alleviated.

As described above, the light source module 1 according to the present embodiment includes the thermal diffusion member 300 which is disposed between the stem 106 and the connection portion 204 and is thermally connected to the light emitting element 104. In this way, it is possible to enhance the heat dissipation of the light emitting element 104. Further, the terminals 108, 110 of the light source 100 have the bent portions 108*a*, 110*a* which are deformed in accordance with the dimensional change in at least one of the thermal diffusion member 300, the terminals 108, 110, the wiring portion 200 and the connection member 204*a*. In this way, it is possible to prevent the connection reliability between the light source 100 and the wiring portion 200 from being decreased due to the dimensional change. Therefore, according to the light source module 1 of the present embodiment, it is possible to achieve both improvement in heat dissipation of the light source 100 and prevention of decrease in connection reliability between the light source 100 and the wiring portion 200.

Meanwhile, the bent portions 108*a*, 110*a* can have the shapes illustrated in the following modified examples.

First Modified Example

Figure 4A:
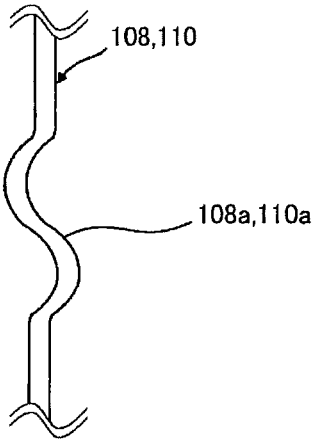
FIG. 4A is a view schematically showing the shape of bent portions according to a first modified example. FIGS.

FIG. 4A is a view schematically showing the shape of bent portions according to a first modified example. As shown in FIG. 4A, the bent portions 108*a*, 110*a* may have a shape which is curved so as to protrude in a direction intersecting with an arrangement direction of the light source 100 and the wiring portion 200. Alternatively, the bent portions 108*a*, 110*a* may have a bellows shape.

Second Modified Example

Figure 4B:
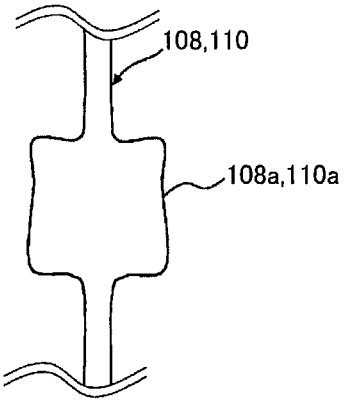
FIG. 4D is a view schematically showing the shape of bent portions according to a third modified example.
Figure 4C:
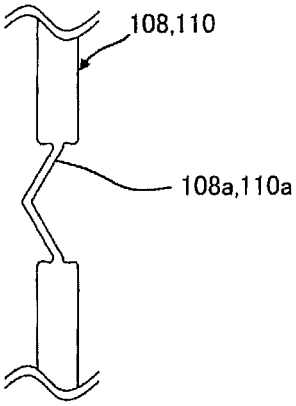

FIGS. 4B and 4C are views schematically showing the shape of bent portions according to a second modified example. FIG. 4C is a view showing a state of the bent portions 108*a*, 110*a* shown in FIG. 4B, as seen from a transverse direction. As shown in FIGS. 4B and 4C, the bent portions 108*a*, 110*a* may be configured by a kink that is obtained by squeezing and bending a predetermined region of the terminals 108, 110, or may be configured by a conductive ribbon. When the bent portions 108*a*, 110*a* are configured by the kink, the squeezing and bending of the terminals 108, 110 can be simultaneously performed, and therefore, the bent portions 108*a*, 110*a* can be simply formed.

Third Modified Example

Figure 4D:
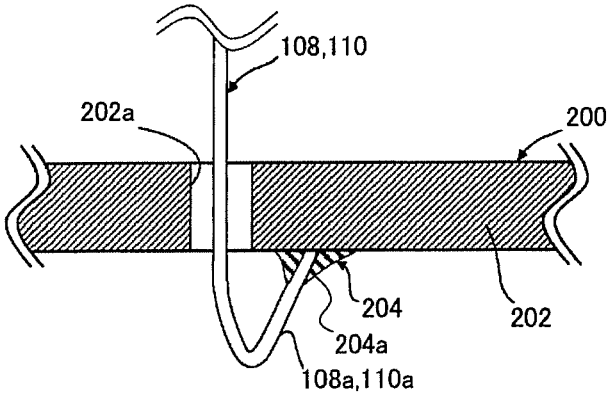

FIG. 4D is a view schematically showing the shape of bent portions according to a third modified example. As shown in FIG. 4D, the bent portions 108*a*, 110*a* may be formed in such a way that leading ends of the terminals 108, 110 protruding from the through holes 202*a* are folded-back toward the board 202. That is, the bent portions 108*a*, 110*a* according to the third modified are configured by claw portions provided at the leading ends of the terminals 108, 110.

Second Embodiment

A light source module 1 according to a second embodiment has the same configuration as the light source module 1 according to the first embodiment except that the stress alleviation mechanism is configured by an elastic material in place of the bent portions 108*a*, 110*a*. Hereinafter, the light source module 1 according to the second embodiment will be described by focusing on the configurations different from the first embodiment, and the common configurations will be briefly described or omitted.

Figure 5:
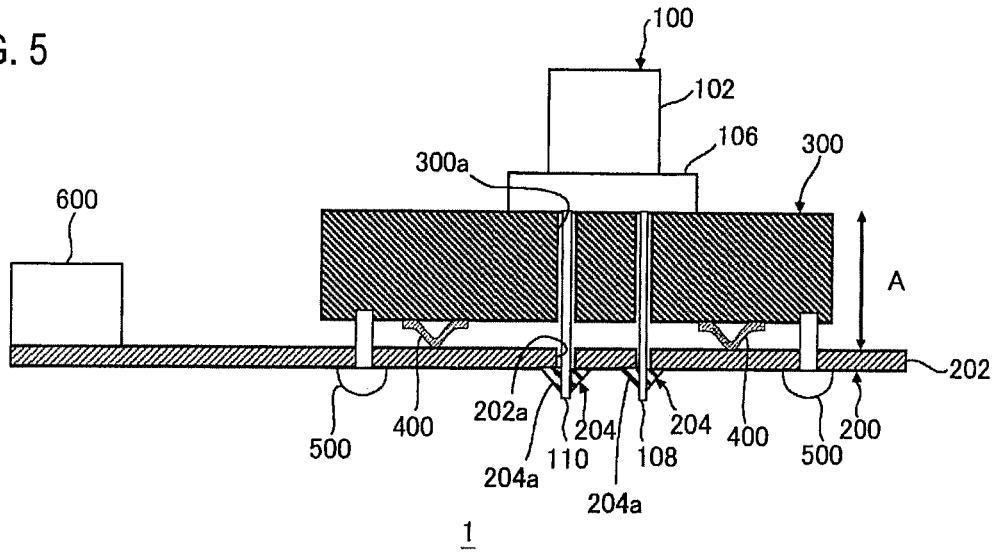
FIG. 5 is a sectional view showing a schematic structure of a light source module according to a second embodiment.

FIG. 5 is a sectional view showing a schematic structure of the light source module according to the second embodiment. In FIG. 5, internal structures of the light source 100 and the external power supply terminal 600 are not shown. The light source module 1 according to the present embodiment includes the light source 100, the wiring portion 200, the connection portion 204, the thermal diffusion member 300, and an elastic material 400.

The light source 100 includes, as a main configuration, the cap 102, the light emitting element 104 (see FIG. 2), the stem 106 for supporting the light emitting element 104, and at least two terminals 108, 110. The light source 100 is a related-art CAN package including the structure of the terminals 108, 110. Therefore, the terminals 108, 110 have a linear shape. One electrode of the light emitting element 104 is electrically connected to one end side of the terminal 108. The other electrode of the light emitting element 104 is electrically connected to one end side of the terminal 110.

The wiring portion 200 is a related-art wiring board and has the board 202 and a wiring pattern (not shown). The board 202 has a plurality of through holes 202*a*. The other end side of the terminals 108, 110 is inserted through the through holes 202*a*. The other end side of the terminals 108, 110 and the one end side of the wiring pattern are electrically connected to each other by being fixed to each other by the connection member 204*a* such as a solder. In this way, the connection portion 204 between the wiring board and the terminals 108, 110 is formed. The external power supply terminal 600 is provided in the board 202. The other end side of the wiring pattern is electrically connected to the external power supply terminal 600. In this way, the terminals 108, 110 are electrically connected to the external power supply terminal 600.

The thermal diffusion member 300 is disposed between the stem 106 and the connection portion 204 and is thermally connected to the light emitting element 104. The thermal diffusion member 300 has a plurality of through holes 300*a*. The terminals 108, 110 are inserted through the through holes 300*a* and the through holes 202*a*, and leading ends thereof are electrically connected to the wiring pattern of the wiring portion 200. The thermal diffusion member 300 is in surface contact with a main surface of the stem 106. Therefore, it is possible to increase the heat dissipation of the light source 100, as compared to a case where the thermal diffusion member 300 is in contact with only the side surface of the stem 106.

The elastic material 400 is interposed between the wiring portion 200 and the thermal diffusion member 300. The thermal diffusion member 300 is supported on the surface of the board 202 by the elastic material 400. A plurality of elastic materials 400 is provided at predetermined positions on the board 202 so as to stably support the thermal diffusion member 300. The elastic materials 400 of the present embodiment have a spring structure and can be elastically deformed by a force in a direction (a height direction of the elastic materials 400) parallel to an arrangement direction of the light source 100 and the wiring portion 200.

The thermal diffusion member 300 is fixed to the wiring portion 200 by fasteners 500 such as screws. Fastening torque of the fasteners 500 is preferably in a range of 0.5 to 4 kg·cm. By setting the fastening torque in this range, it is possible to achieve both stress alleviation effect by elastic deformation of the elastic materials 400 and fixation of the thermal diffusion member 300 to the wiring portion 200.

Similar to the first embodiment, when the dimension of at least one of the thermal diffusion member 300, the terminals 108, 110, the wiring portion 200 and the connection member 204*a* is changed, the force A of widening the gap between the light source 100 and the connection portion 204 can occur in the light source module 1. On the other hand, the light source module 1 has the elastic materials 400 as a stress alleviation mechanism for alleviating the stress applied to the connection portion 204 due to the dimensional change in at least one of the thermal diffusion member 300, the terminals 108, 110, the wiring portion 200 and the connection member 204*a*. The elastic materials 400 are deformed in accordance with the dimensional change in at least one of the thermal diffusion member 300, the terminals 108, 110, the wiring portion 200 and the connection member 204*a*. Specifically, when the dimension of at least one of the thermal diffusion member 300, the terminals 108, 110, the wiring portion 200 and the connection member 204*a* is changed, the elastic materials 400 are pressed by the thermal diffusion member 300 and the wiring portion 200 and are elastically deformed so that the height is reduced. In this way, a space between the elastic materials 400 and the stem 106 or a space between the connection portion 204 and the elastic materials 400 is widened, so that the dimensional change of each part is allowed. As a result, the stress applied to the connection portion 204 is alleviated.

As described above, the light source module 1 according to the present embodiment includes the thermal diffusion member 300 which is disposed between the stem 106 and the connection portion 204 and is thermally connected to the light emitting element 104. In this way, it is possible to enhance the heat dissipation of the light emitting element 104. Further, the light source module 1 includes the elastic materials 400 which are interposed between the board 202 and the thermal diffusion member 300 and are deformed in accordance with the dimensional change in at least one of the thermal diffusion member 300, the terminals 108, 110, the wiring portion 200 and the connection member 204*a*. In this way, it is possible to prevent the connection reliability between the light source 100 and the wiring portion 200 from being decreased due to the dimensional change. Therefore, according to the light source module 1 of the present embodiment, it is possible to achieve both improvement in heat dissipation of the light source 100 and prevention of decrease in connection reliability between the light source 100 and the wiring portion 200.

Meanwhile, the elastic materials 400 can be modified as in the following modified examples.

Fourth Modified Example

Figure 6:
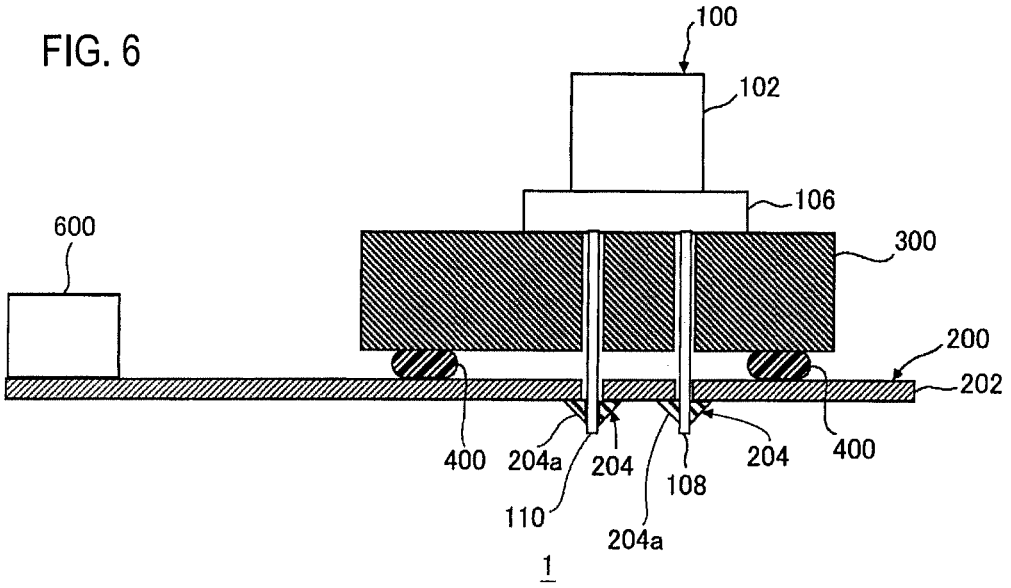
FIG. 6 is a sectional view showing a schematic structure of a light source module according to a fourth modified example.

FIG. 6 is a sectional view showing a schematic structure of a light source module according to a fourth modified example. As shown in FIG. 6, a light source module 1 according to the present modified example includes an elastic material 400 made of an elastic adhesive. The elastic adhesive is an adhesive which, after being cured, can be elastically deformed enough to absorb the dimensional change in the thermal diffusion member 300 or the like. For example, the elastic adhesive can include an adhesive mainly composed of silicone polymer. Preferably, elastic modulus of the elastic adhesive is in a range of $10^6$ to $10^8$ Pa.

When the dimension of at least one of the thermal diffusion member 300, the terminals 108, 110, the wiring portion 200 and the connection member 204*a* is changed, the elastic material 400 is elastically deformed by being pressed by the thermal diffusion member 300 and the board 202. In this way, the dimensional change of each part is allowed, and hence, the stress applied to the connection portion 204 is alleviated. Further, the thermal diffusion member 300 is fixed to the board 202 by an adhesive force of the elastic material 400. Therefore, when the elastic material 400 is configured by the elastic adhesive, both a function as a stress alleviation mechanism and a function of fixing the thermal diffusion member 300 to the wiring portion 200 may be imparted to the elastic material 400. As a result, it is possible to reduce the number of parts of the light source module 1 and to reduce manufacturing cost thereof.

Third Embodiment

A light source module 1 according to a third embodiment has the same configuration as the light source module 1 according to the first embodiment except that the stress alleviation mechanism is configured by a bus bar in place of the bent portions 108*a*, 110*a*. Hereinafter, the light source module 1 according to the third embodiment will be described by focusing on the configurations different from the first embodiment, and the common configurations will be briefly described or omitted.

Figure 7A:
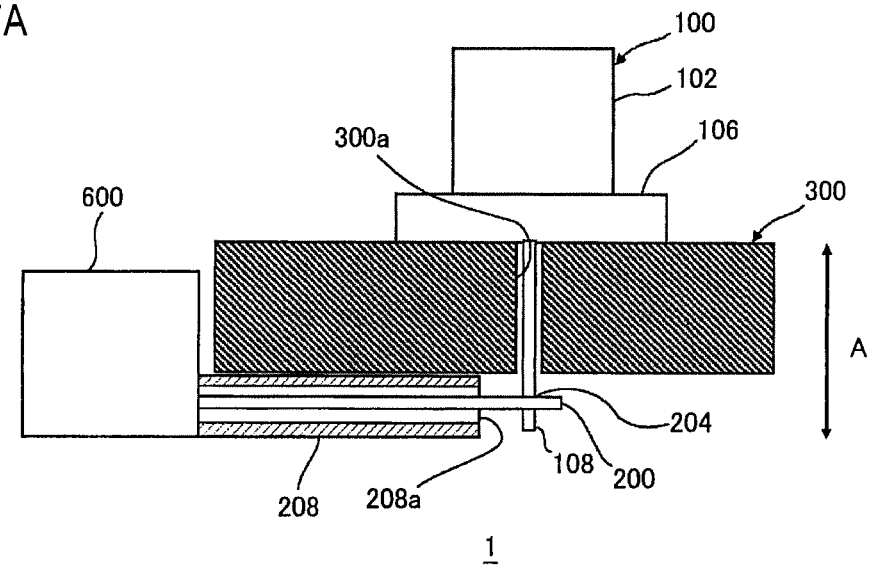
FIG. 7A is a sectional view showing a schematic structure of a light source module according to a third embodiment.
Figure 7B:
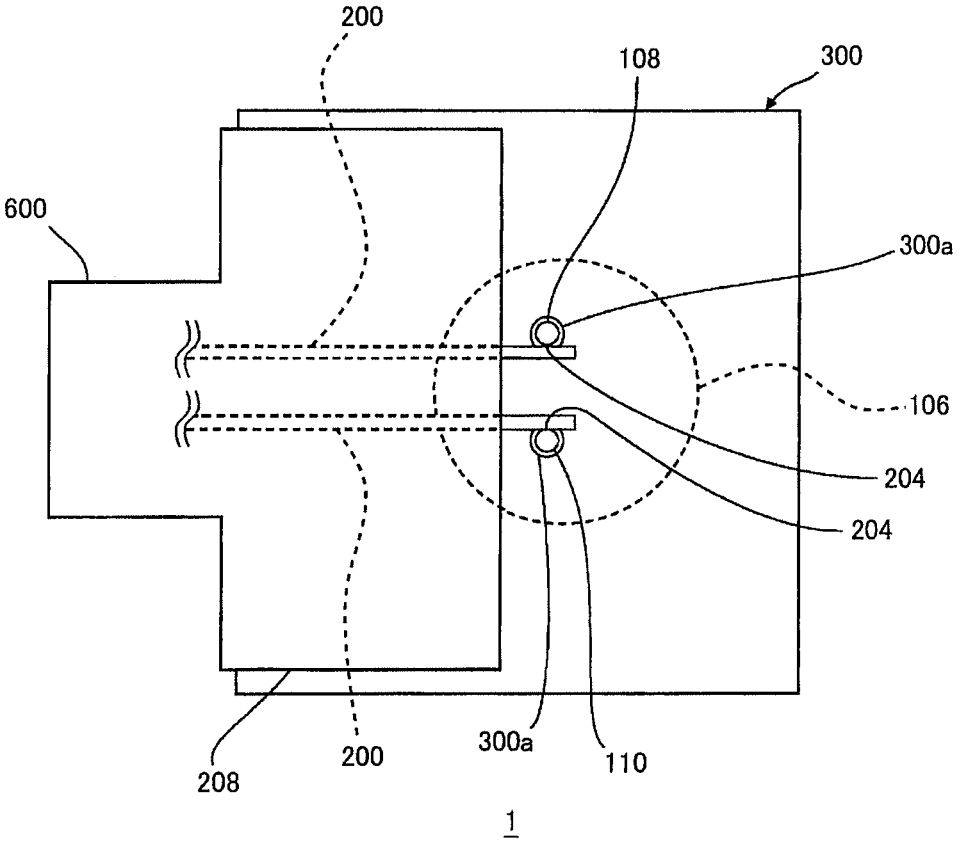
FIG. 7B is a view showing a state of the light source module, as seen from a connection portion side between a terminal and a bus bar.

FIG. 7A is a sectional view showing a schematic structure of the light source module according to the third embodiment. FIG. 7B is a view showing a state of the light source module, as seen from a connection portion side between a terminal and a bus bar. In FIG. 7A, internal structures of the light source 100 and the external power supply terminal 600 are not shown. The light source module 1 according to the present embodiment includes the light source 100, the wiring portion 200, the connection portion 204, and the thermal diffusion member 300.

The light source 100 includes, as a main configuration, the cap 102, the light emitting element 104 (see FIG. 2), the stem 106 for supporting the light emitting element 104, and at least two terminals 108, 110. The light source 100 is a related-art CAN package including the structure of the terminals 108, 110. Therefore, the terminals 108, 110 have a linear shape. One electrode of the light emitting element 104 is electrically connected to one end side of the terminal 108. The other electrode of the light emitting element 104 is electrically connected to one end side of the terminal 110.

The wiring portion 200 is a related-art bus bar and is configured by a metal rod-like body. Therefore, the wiring portion 200 can be elastically deformed. One end side of the wiring portion 200 is fixed to the other end side of the terminals 108, 110 by a welding or the like, so that the wiring portion 200 and the terminals 108, 110 are electrically connected to each other. In this way, the connection portion 204 between the bus bar and the terminals 108, 110 is formed. When the terminals 108, 110 and the wiring portion 200 are fixed to each other by the welding, the light source 100 and the wiring portion 200 can be more strongly connected, as compared to a solder bonding. The wiring portion 200 extends in a direction intersecting with an arrangement direction of the stem 106 and the connection portion 204.

The other end side of the wiring portion 200 is accommodated in a housing 208. The housing 208 is a case having a space for accommodating the wiring portion 200. The housing 208 has an opening 208*a* through which the wiring portion 200 is inserted. The external power supply terminal 600 is provided on the side opposite to the opening 208*a* of the housing 208. In the present embodiment, the external power supply terminal 600 has a connector shape. The external power supply terminal 600 and the housing 208 are integrally molded. The wiring portion 200 extends to the external power supply terminal 600 side through the opening 208*a* of the housing 208, so that the other end side of the wiring portion 200 is electrically connected to the external power supply terminal 600. In this way, the terminals 108, 110 are electrically connected to the external power supply terminal 600. When the external power supply terminal 600 and the housing 208 are integrally molded, it is possible to reduce the number of parts of the light source module 1 and to reduce manufacturing cost thereof. Further, it is possible to improve the connection reliability between the wiring portion 200 and the external power supply terminal 600.

The thermal diffusion member 300 is disposed between the stem 106 and the connection portion 204 and is thermally connected to the light emitting element 104. Further, a main surface of the thermal diffusion member 300 facing the connection portion 204 is in contact with the housing 208. The thermal diffusion member 300 is fixed to the housing 208 by fasteners (not shown) such as screws, for example. Furthermore, a portion of the thermal diffusion member 300 is sandwiched between the housing 208 and the stem 106. The thermal diffusion member 300 has a plurality of through holes 300*a*. The terminals 108, 110 are inserted through the through holes 300*a*, and hence, leading ends thereof are electrically connected to one end side of the wiring portion 200. The thermal diffusion member 300 is in surface contact with a main surface of the stem 106. Therefore, it is possible to increase the heat dissipation of the light source 100, as compared to a case where the thermal diffusion member 300 is in contact with only the side surface of the stem 106.

Similar to the first embodiment, when the dimension of at least one of the thermal diffusion member 300, the terminals 108, 110 and the wiring portion 200 is changed, the force A of widening the gap between the light source 100 and the connection portion 204 can occur in the light source module 1. On the other hand, the light source module 1 has the wiring portion 200 configured by the bus bar, as a stress alleviation mechanism for alleviating the stress applied to the connection portion 204 due to the dimensional change in at least one of the thermal diffusion member 300, the terminals 108, 110 and the wiring portion 200. The bus bar is deformed in accordance with the dimensional change in at least one of the thermal diffusion member 300, the terminals 108, 110 and the wiring portion 200. Specifically, when the dimension of at least one of the thermal diffusion member 300, the terminals 108, 110 and the wiring portion 200 is changed, along with this, a displacement force in an arrangement direction of the light source 100 and the wiring portion 200 is applied to the connection portion 204. When the force is applied to the connection portion 204, the wiring portion 200 that is the bus bar is elastically deformed with the side (the other end side) accommodated in the housing 208 as a support point, and hence, an end of the wiring portion 200 on the connection portion 204 side (one end side) is displaced. In this way, the connection portion 204 is allowed to be displaced in accordance with the dimensional change in at least one of the thermal diffusion member 300, the terminals 108, 110 and the wiring portion 200. As a result, the stress applied to the connection portion 204 is alleviated.

As described above, the light source module 1 according to the present embodiment includes the thermal diffusion member 300 which is disposed between the stem 106 and the connection portion 204 and is thermally connected to the light emitting element 104. In this way, it is possible to enhance the heat dissipation of the light emitting element 104. Further, the light source module 1 has the wiring portion configured by the bus bar. In this way, it is possible to prevent the connection reliability between the light source 100 and the wiring portion 200 from being decreased due to the dimensional change in at least one of the thermal diffusion member 300, the terminals 108, 110 and the wiring portion 200. Therefore, according to the light source module 1 of the present embodiment, it is possible to achieve both improvement in heat dissipation of the light source 100 and prevention of decrease in connection reliability between the light source 100 and the wiring portion 200.

The present invention is not limited to respective embodiments described above or modifications thereof. The respective embodiments and modifications thereof may be combined, or additional modification such as various design changes may be added to the respective embodiments, based on the knowledge of those skilled in the art. New embodiments which are obtained by such combinations or additional modifications are also included in the scope of the present invention. These new embodiments have the effects of the respective embodiments which are combined and the modifications thereof.

The stress alleviation mechanism in each of the first to third embodiments and the first to fourth modified examples can be suitably combined. In other words, two or more of the bent portions 108*a*, 110*a*, the elastic material 400 and the bus bar can be combined. In this way, it is possible to more reliably suppress a decrease in connection reliability between the light source 100 and the wiring portion 200. Further, in each of the embodiments and the modified examples, the light source 100 may be a laser light source other than a CAN package. Further, the light emitting element 104 may be an LED or the like. Further, in each of the embodiments and the modified examples, the posture of the light source 100 relative to the position of the external power supply terminal 600, i.e., an arrangement direction of the terminals 108, 110 is not limited to those shown.

Meanwhile, the invention according to the embodiments and the modified examples described above may be specified by the items described below.

[Item 1]

A light source module includes a light source having a light emitting element, a stem configured to support the light emitting element, and a terminal, one end side of which is electrically connected to the light emitting element;

a wiring portion to which the other end of the terminal is electrically connected and which is configured to electrically connect the terminal to an external power supply terminal; and a thermal diffusion member disposed between the stem and a connection portion of the wiring portion and the terminal and thermally connected to the light emitting element, Wherein the light source module includes a stress alleviation mechanism configured to alleviate the stress applied to the connection portion due to the occurrence of heat from the light source.

[Item 2]

In the light source module of the item 1, the stress alleviation mechanism is configured by a bent portion provided in the terminal.

[Item 3]

In the light source module of the item 1, the wiring portion is a wiring board, and the stress alleviation mechanism is configured by an elastic material interposed between the wiring board and the thermal diffusion member.

[Item 4]

In the light source module of the item 1, the wiring portion is a bus bar, and the stress alleviation mechanism is configured by the bus bar and alleviates the stress using the elasticity of the bus bar.

What is claimed is:

1. A light source module comprising:

a light source having a light emitting element, a stem configured to support the light emitting element, and a terminal, one end side of which is electrically connected to the light emitting element;

a wiring portion to which the other end of the terminal is electrically connected and which is configured to electrically connect the terminal to an external power supply terminal;

a connection portion configured to fix the wiring portion and the other end side of the terminal by a connection member; and a thermal diffusion member disposed between the stem and the connection portion and thermally connected to the light emitting element, wherein the terminal comprises:

an upper straight portion, a lower straight portion parallel to the upper straight portion, and a bent portion that is disposed between the upper straight portion and the lower straight portion, and that is configured to be deformed in accordance with dimensional change in at least one of the thermal diffusion member, the terminal, the wiring portion and the connection member.

2. The light source module according to claim 1, wherein, when the bent portion is deformed in accordance with expansion in at least one of the thermal diffusion member, the terminal, the wiring portion, and the connection member, the bent portion becomes longer in a direction parallel to the upper and lower straight portions, and wherein, when the bent portion is deformed in accordance with contraction in at least one of the thermal diffusion member, the terminal, the wiring portion and the connection member, the bent portion becomes shorter in a direction parallel to the upper and lower straight portions.

3. A light source module comprising:

a light source having a light emitting element, a stem configured to support the light emitting element, and a terminal, one end side of which is electrically connected to the light emitting element;

a wiring portion to which the other end of the terminal is electrically connected and which is configured to electrically connect the terminal to an external power supply terminal;

a connection portion configured to fix the wiring portion and the other end side of the terminal by a connection member; and a thermal diffusion member disposed between the stem and the connection portion and thermally connected to the light emitting element, wherein the terminal has a bent portion which is configured to undergo deformation in accordance with dimensional change in at least one of the thermal diffusion member, the terminal, the wiring portion and the connection member, wherein, when the bent portion is deformed in accordance with expansion in at least one of the thermal diffusion member, the terminal, the wiring portion and the connection member, the bent portion is straighter after the deformation than before the deformation, and wherein, when the bent portion is deformed in accordance with contraction in at least one of the thermal diffusion member, the terminal, the wiring portion and the connection member, the bent portion is straighter before the deformation than after the deformation.

4. A light source module comprising:

a light source having a light emitting element, a stem configured to support the light emitting element, and a terminal, one end side of which is electrically connected to the light emitting element;

a wiring portion to which the other end of the terminal is electrically connected and which is configured to electrically connect the terminal to an external power supply terminal;

a connection portion configured to fix the wiring portion and the other end side of the terminal by a connection member; and a thermal diffusion member disposed between the stem and the connection portion and thermally connected to the light emitting element, wherein the terminal comprises:

a first fixed portion fixed to the stem, a second fixed portion fixed to the wiring portion, and a bent portion that is disposed between the first fixed portion and the second fixed portion, and that is configured to be deformed in accordance with dimensional change in at least one of the thermal diffusion member, the terminal, the wiring portion, and the connection member, wherein, when the bent portion is deformed in accordance with expansion in at least one of the thermal diffusion member, the terminal, the wiring portion and the connection member, the bent portion is configured to be deformed such that a distance between the first fixed portion and the second fixed portion increases, and wherein, when the bent portion is deformed in accordance with contraction in at least one of the thermal diffusion member, the terminal, the wiring portion and the connection member, the bent portion is configured to be deformed such that a distance between the first fixed portion and the second fixed portion decreases.

* * * * *